United States Patent [19]

Guldager

[11] Patent Number: 4,651,369

[45] Date of Patent: Mar. 24, 1987

[54] CELLULAR ELEMENT

[76] Inventor: Hans Guldager, Rypevang 4, Allerød, Denmark, 3450

[21] Appl. No.: 784,388

[22] Filed: Oct. 4, 1985

[30] Foreign Application Priority Data

Oct. 11, 1984 [DK] Denmark ..... 4868/84

[51] Int. Cl.[4] ..... A47C 27/08

[52] U.S. Cl. ..... 5/455; 128/33; 137/869; 251/61.1

[58] Field of Search ..... 128/33, 38; 114/345; 441/41; 251/61.1, 61; 297/453, DIG. 3; 5/421, 423, 448–450, 453–458, 465, 469; 137/869

[56] References Cited

U.S. PATENT DOCUMENTS

| | | | |
|---|---|---|---|
| 2,391,906 | 1/1946 | Kearney | 114/345 |
| 2,575,240 | 11/1951 | Thompson | 83/513 |
| 2,751,933 | 6/1956 | Urteaga | 137/635 |
| 3,008,465 | 11/1961 | Gal | 128/33 |
| 3,320,750 | 5/1967 | Haise et al. | 405/37 |
| 3,822,425 | 7/1974 | Scales | 5/456 |
| 3,909,858 | 10/1975 | Ducker | 5/455 |
| 4,448,228 | 5/1984 | Hashimoto | 141/114 |
| 4,467,999 | 8/1984 | Ritter | 251/61.1 |
| 4,552,133 | 11/1985 | Kawaguchi | 128/44 |

FOREIGN PATENT DOCUMENTS

| | | | |
|---|---|---|---|
| 401767 | 10/1969 | Australia | 5/456 |
| 1122337 | 1/1962 | Fed. Rep. of Germany | 251/61.1 |
| 1189927 | 10/1959 | France | 5/455 |
| 83676 | 7/1981 | Japan | 251/61 |

OTHER PUBLICATIONS

Michelitsch, "Valve", 10/5/1964, p. 367, IBM Technical Disclosure Bulletin.

*Primary Examiner*—John E. Murtagh
*Assistant Examiner*—Andrew Joseph Rudy
*Attorney, Agent, or Firm*—Holman & Stern

[57] ABSTRACT

In a cellular element the individual cells (1) are connected via a narrowed passage (2) to another cell or to a duct (3), which can be connected via a valve to a first pressure source. Hollow, expansible bodies (4) of an elastic, yielding material are placed in the duct and/or in one or more cells (1). The bodies (4) are interconnected via one or more yielding organs (5) in such a way that when they expand, they prevent outflow from the cells (1).

The yielding organ or organs (5) may appropriately be tubes connecting the interior of the expansible bodies (4) with a second pressure source.

An expansible body (4) may be placed in each cell (1), and the yielding organ or organs (5) is/are then shaped and dimensioned in such a way that when the body (4) is expanded, it bears against the mouth of the passage (2) into the cell (1) and tightens it.

3 Claims, 2 Drawing Figures

CELLULAR ELEMENT

The present invention concerns a cellular element where the individual cells are connected via a narrowed passage to a duct, which can be connected via a valve to a pressure source.

Such elements are used e.g. in air mattresses and rubber boats, where all cells may be connected to a common duct. This implies that if one cell is punctured, the entire element will be emptied of pressure medium, because all cells are interconnected via the duct. In order to avoid this the cells may be divided into groups so that each group of cells is connected to its own duct, which is equipped with a valve. If the element is constructed in this way, puncture of one cell will only imply that the cells in the same group are emptied. On the other hand, the blowing up of the element will require that one duct after the other is connected to a pressure source. This makes it difficult to obtain equal pressures in all cells, and it is time-consuming. Further, there is a risk of one or more cell groups being forgotten when the element is blown up.

According to the present invention it is suggested that hollow, expansible bodies of an elastic, yielding material should be placed in the duct and/or in one or more cells. These bodies must be interconnected in such a way via one or more yielding organs that the bodies, when expanding, prevent outflow from the cells.

By this method the following advantage is obtained: When the expansible bodies expand, they will act as non-return valves, which may be distributed in a suitable manner in the cellular element.

The hollow, expansible bodies may be filled with a medium which expands them when heated. However, according to the invention it is appropriate that the yielding organ or organs is/are tubes which connect the interior of the expansible bodies with a second pressure source. If it is desirable that the interior of each cell can be shut off in relation to the interior of all other cells, it is appropriate according to the invention that an expansible body is placed in each cell, and that the yielding organ or organs is/are shaped and dimensioned in such a way that the body, when expanded, bears against the mouth of the passage into the cell and tightens it. At the same time, the placing of the expansible body against the mouth of the passage implies that an external pressure against the cell cannot open the non-return valve.

Figure 1:
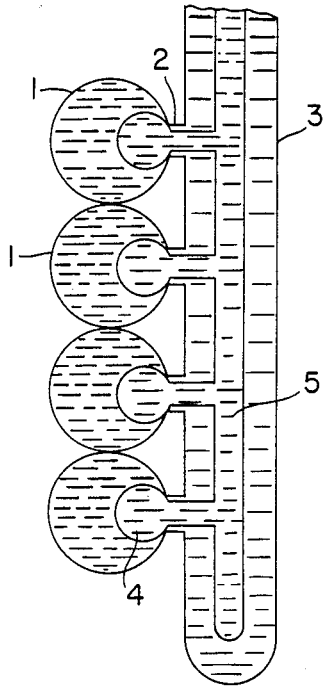
Figure 2:
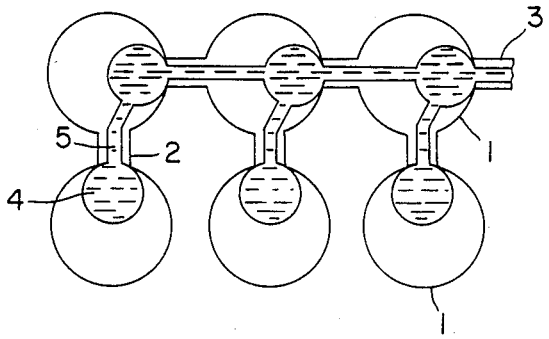

In the following the invention will be explained in more detail in connection with the drawing, where FIG. 1 shows schematically a section through a cellular, inflatable element, and FIG. 2 shows a section through another version of a cellular, inflatable element.

The individual cells 1 in the cellular element are connected via a narrowed passage 2 to another cell 1 (FIG. 1) or to a duct 3, which can be connected via a valve, which is not shown, to a first pressure source, e.g. a compressor or a pump. In the versions shown here a hollow, expansible body 4 of an elastic, yielding material is placed in each cell 1. The bodies are interconnected via yielding organs, here in the form of tubes 5, through which the interior of the bodies 4 can be connected to a second pressure source.

When the bodies 4 are expanded, principally by being filled with air or another medium under pressure, they will bear against the mouths of the passages 2 into the cells in question 1, closing them tightly. Hereby the bodies will act as non-return valves and prevent outflow from the cells 1. However, it is possible to lead air or another medium into the cells under pressure.

In the versions shown here each cell 1 has its own non-return valve in the form of a hollow, expansible body 4. Thus, if a cell is punctured, it will not influence the pressure in the rest of the cells.

Alternatively, the cells may be divided into groups, each group having a non-return valve attached to it. In cellular elements where each cell has its own non-return valve, the cells may also be divided into groups, whereby the expansible bodies of each group are mutually connected to the bodies of other groups and their tubes.

I claim:

1. A cellular assembly comprising a first network of inflation cells interconnected by first conduit means to a first inflation duct, each cell having an inlet-outlet aperture communicating with the first conduit means, and a second network of individual inflation bodies contained within the respective cells for closing the respective inlet-outlet apertures when the bodies are expanded and opening the respective apertures when the bodies are contracted, the bodies being interconnected by second conduit means contained within the first conduit means to a second inflation duct within the first inflation duct.

2. An assembly as defined in claim 1 wherein the inflation cells and inflation bodies are connected individually to the respective inflation ducts by separate conduits defining the respective conduit means.

3. An assembly as defined in claim 1 wherein the inflation cells and inflation bodies are interconnected in parallel pairs by respective conduits defining the respective conduit means and one each of the cells and bodies are connected to the respective first and second inflation ducts.

* * * * *